US009689616B2

(12) United States Patent
Clesen et al.

(10) Patent No.: US 9,689,616 B2
(45) Date of Patent: Jun. 27, 2017

(54) DEVICE FOR SUPPLYING RINSING MEDIUM IN A HAMMER DRILL

(75) Inventors: Romain Clesen, Colpch Haut (LU); Michael Wolfsberger, Trofaiach (AT)

(73) Assignee: TMT-BBG RESEARCH AND DEVELOPMENT GMBH, Kapfenberg (AT)

( * ) Notice: Subject to any disclaimer, the term of this patent is extended or adjusted under 35 U.S.C. 154(b) by 676 days.

(21) Appl. No.: 13/606,749

(22) Filed: Sep. 7, 2012

(65) Prior Publication Data

US 2013/0062089 A1 Mar. 14, 2013

(30) Foreign Application Priority Data

Sep. 8, 2011 (AT) ..... 1294/2011

(51) Int. Cl.
*B25D 17/14* (2006.01)
*F27D 3/15* (2006.01)
*C21B 7/12* (2006.01)

(52) U.S. Cl.
CPC ..... *F27D 3/1527* (2013.01); *C21B 7/12* (2013.01)

(58) Field of Classification Search
CPC ..... B25F 3/00; B25F 5/00; B25F 5/02
USPC ..... 173/197
See application file for complete search history.

(56) References Cited

U.S. PATENT DOCUMENTS 3,763,941 A * 10/1973 Leibee et al. ..... 173/197
4,488,759 A * 12/1984 Bergqvist ..... E21C 35/187 299/110
4,545,443 A 10/1985 Wiredal
4,805,705 A 2/1989 Liljebrand et al.
5,129,467 A * 7/1992 Watanabe et al. ..... 173/75
5,316,419 A * 5/1994 Bohnet ..... B23B 51/0027 279/6

(Continued)

FOREIGN PATENT DOCUMENTS

DE 11 88 014 7/1962
DE 3 024 102 9/1982

(Continued)

OTHER PUBLICATIONS

Austrian Search Report conducted in counterpart Austrian Appln. No. A 1294/2011 (Mar. 8, 2012).

(Continued)

*Primary Examiner* — Robert Long
(74) *Attorney, Agent, or Firm* — Greenblum & Bernstein, P.L.C.

(57) ABSTRACT

A device for supplying a rinsing medium to a tool of a hammer drill and a hammer drill. The device includes at least one of a rotatable and axially displaceable drilling tool holder having at least one supply channel for the rinsing medium, a transfer part interacting with the drilling tool holder, a housing, a feeder structured and shaped essentially in an axially symmetrical manner, and a holding part with a rinsing medium inlet. The feeder and the holding part are arranged as a connected component, and friction bearings are arranged on both sides of the feeder and arranged toward the drilling tool holder. The holding part is structured to be radially displaceable within limits via bending with respect to at least one of the housing and a fixing ring connected to the housing, but positively fixed tangentially.

20 Claims, 1 Drawing Sheet

(56) References Cited

U.S. PATENT DOCUMENTS

| | | | | |
|---|---|---|---|---|
| 5,348,430 | A * | 9/1994 | Metz | C21B 7/12 266/271 |
| 5,350,023 | A * | 9/1994 | Klemm | E21B 4/14 173/136 |
| 5,419,403 | A * | 5/1995 | Klemm | E21B 4/14 173/115 |
| 6,270,296 | B1 * | 8/2001 | Steiner | B23B 51/102 408/159 |
| 6,575,254 | B2 * | 6/2003 | Bongers-Ambrosius et al. | 173/201 |
| 7,967,084 | B2 * | 6/2011 | Murray | 175/214 |
| 8,029,211 | B2 * | 10/2011 | Bayerl | E21B 21/02 175/214 |
| 8,910,645 | B2 * | 12/2014 | Piccioni | A46B 17/06 134/149 |
| 2007/0177949 | A1 * | 8/2007 | Koehler | E21B 17/0426 405/259.1 |
| 2007/0261195 | A1 * | 11/2007 | Bleicher | B08B 15/04 15/344 |
| 2008/0040945 | A1 * | 2/2008 | Buckner | 34/406 |
| 2011/0208192 | A1 * | 8/2011 | Palti | A61B 17/1617 606/79 |
| 2012/0318553 | A1 * | 12/2012 | Chen et al. | 173/198 |

FOREIGN PATENT DOCUMENTS

| | | |
|---|---|---|
| EP | 0 197 019 | 10/1986 |
| EP | 0 563 950 | 10/1993 |
| SU | 1011057 | 4/1983 |
| TW | M323350 | 10/1996 |
| TW | M364562 | 9/2009 |
| TW | M367038 | 10/2009 |

OTHER PUBLICATIONS

English language translation of Ukraine Office Action conducted in counterpart Ukraine Appln. No. a 2012 10581.

English language translation of Ukraine Decision on Grant conducted in counterpart Ukraine Appln. No. a 2012 10581.

English language translation of Taiwan Office Action conducted in counterpart Taiwan Appln. No. 101129168.

English language translation of Repub. of China Patent Certificate in counterpart Taiwan Appln. No. 101129168.

European Office Action conducted in counterpart European Appln. No. 12181514.6-1215 (Nov. 12, 2016) (w/translation).

Machine language translation of Japan Office Action conducted in counterpart Japan Appln. No. 2012-192 457 (Oct. 29, 2013).

* cited by examiner

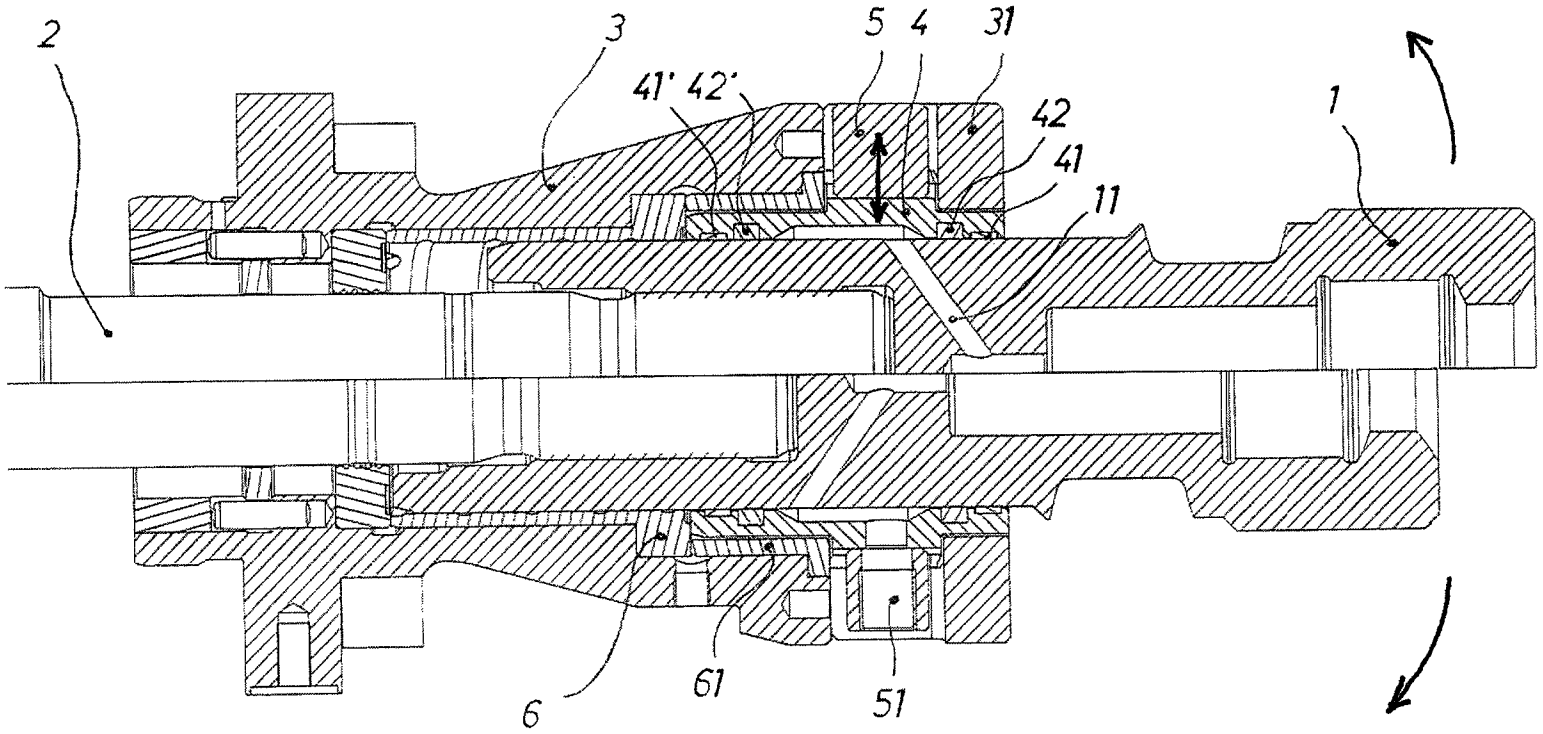
1
11
42
41
31
4
5
41'
42'
3
2
51
61
6

DEVICE FOR SUPPLYING RINSING MEDIUM IN A HAMMER DRILL

The present application claims priority under 35 U.S.C. §119 of Austrian Patent Application No. A 1294/2011 filed Sep. 8, 2011, the disclosure of which is expressly incorporated by reference herein in its entirety.

BACKGROUND OF THE INVENTION

1. Field of the Invention

The invention relates to a device for supplying a rinsing medium to the tool of a hammer drill, and, in particular, to a tool of a taphole power drill at the blast furnace, including essentially a rotatable and/or axially displaceable drilling tool holder with at least one supply channel for the rinsing medium, a transfer part interacting with the drilling tool holder, a housing and a feeder as well as a holding part with a rinsing medium inlet.

2. Discussion of Background Information

Hammer drills with a drilling tool in heavy impact operation and optionally rotary operation, in particular for opening taphole openings of metallurgical vessels, usually require a supply of a rinsing agent to the work area of the tool in order to carry out drill cuttings from the bore hole and optionally to cool the tool blades.

In general, the drilling tool having at least one rinsing agent channel running axially is fixed in a drilling tool holder or adapter, which is supported in a housing in a displaceable and rotatable manner within limits.

A supply of a rinsing medium can be carried out by lines or recesses from the housing into the drilling tool holder. Further, seals prevent the medium from escaping between these parts.

However, this type of rinsing agent guidance to the tool has the disadvantage that with a moderate wear of bearing points between the drilling tool holder and the housing of the hammer, even though it rendered possible a further trouble-free hammer operation, a repair has to be carried out due to sealing problems.

It has already been tried to arrange a separate feeder for a rinsing agent on a drilling tool holder extended in the axial direction, which is not integrated into the hammer housing, but this has the disadvantages of a shortened drill length and an increased load on the bearing points.

SUMMARY OF THE EMBODIMENTS

Embodiments of the invention overcome the disadvantages of the prior art and create a device for supplying a rinsing medium to the tool of a hammer drill, in particular, to a tool of a taphole power drill on a metallurgical vessel of the type mentioned at the outset. The device has low abrasion in hard drill operation and at the same time essentially necessitates a replacement of the bearing bushings between the drilling tool holder and the housing and a replacement of the seals in the feed path for the rinsing agent.

Accordingly, the embodiments includes an innovative manner with a generic device in that a feeder shaped essentially in a axially symmetrical manner and the associated holding part form a preferably permanently connected component. The feeder has on both sides respectively distal friction bearings, in particular guide belts and seals towards the drilling tool holder and the holding part is radially displaceable in limits with bending with respect to the housing and/or a fixing ring connected thereto, but is positively fixed tangentially.

The advantages obtained with the feeders and the associated holding part according to the embodiments are essentially that this is shaped to be radially moveable within limits as a so-called "floating" feeder or feed element, which can bear against the drilling tool holder in a sealing manner, and a guide through the housing takes place positively only in the direction of rotation. The drilling tool holder with an abrasion of the bearing points within limits can perform a radial displacement in the housing. Although the component, feeder with holding part, is secured against twisting, it can follow a displacement of the drilling tool holder.

Furthermore, an embodiment variant is advantageous in which the radially displaceable component, formed by the feeder for the rinsing medium and holding part, is positioned axially adjacent to the bearing bushing, fixed by a spacer element, and after the release of the fixing ring from the housing the component with the feeder together with guide belts and seals and the bearing bushing with spacer element can be drawn out thereof.

In this manner, with an essentially simultaneous wear of the bearings and sealing elements, a repair can be quickly carried out easily and economically. The seals and the guide belts of the feeder for the rinsing medium as well as the bearing bushing for the drilling tool holder can be replaced in the housing in one operation. No additional components have to be dismantled and assembled. In this manner, the necessary repair time of the hammer drill can be efficiently reduced.

Embodiments of the invention are directed to a device for supplying a rinsing medium to a tool of a hammer drill. The device includes at least one of a rotatable and axially displaceable drilling tool holder having at least one supply channel for the rinsing medium, a transfer part interacting with the drilling tool holder, a housing, a feeder structured and shaped essentially in an axially symmetrical manner, and a holding part with a rinsing medium inlet. The feeder and the holding part are arranged as a connected component, and friction bearings are arranged on both sides of the feeder and arranged toward the drilling tool holder. The holding part is structured to be radially displaceable within limits via bending with respect to at least one of the housing and a fixing ring connected to the housing, but positively fixed tangentially.

According to embodiments, the hammer drill can include a taphole power drill at a blast furnace.

In accordance with other embodiments, the feeder and the holding part can form a permanently connected component.

According to still other embodiments of the invention, the friction bearings may include guide belts and seals. At least one belt and at least one seal can be located on each side of the feeder.

Moreover, the feeder may be structured with an axial extent that corresponds to an axial extent of movement for the drilling tool holder. The drilling tool holder may include a tool receiving region. A feed channel can be arranged to communicate the rinsing fluid from the feeder to the tool receiving region.

In accordance with still other embodiments, the feeder may be radially displaceable with the holding part. A bearing bushing may be axially adjacent the feeder. Further, a spacer element can be axially adjacent the bearing bushing. The spacer element may be arranged to surround at least a portion of the feeder.

According to other embodiments, the fixing ring can be releasable from the housing to facilitate removal of the holding part and the feeder. Further, the friction bearings may be removable with the feeder.

Embodiments of the invention are directed to a hammer drill that includes at least one of a rotatable and axially displaceable drilling tool holder having a tool receiving channel, a transfer part structured and arranged to at least one of rotate and axially displace the drilling tool holder, a feeder having a feeder channel surrounding the drilling tool holder and having an axial extent that corresponds to an axial displacement distance of the drilling tool holder, and a rinsing fluid channel formed in the drilling holding part to convey rinsing fluid from the feeder to the tool receiving channel.

According to embodiments, friction bearings may be axially spaced to be arranged on opposite sides of the feeder channel to contact the drilling tool holder.

In accordance with still yet other embodiments of the present invention, a holding part can have a rinsing medium inlet, and the holding part may be arranged to surround the feeder and can be structured to be radially adjustable.

Other exemplary embodiments and advantages of the present invention may be ascertained by reviewing the present disclosure and the accompanying drawing.

BRIEF DESCRIPTION OF THE DRAWING

The present invention is further described in the detailed description which follows, in reference to the noted drawing by way of a non-limiting example of an exemplary embodiment of the present invention, wherein:

The FIGURE illustrates an embodiment of a device for supplying for a rinsing medium to a hammer drill.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 shows in section a device according to the invention. Above the centerline, a drilling tool holder 1 of, e.g., a tool of a hammer drill, and in particular a tool of a taphole power drill on a metallurgical vessel or at a blast furnace, is shown in an extended position and below the centerline is shown in a retracted position.

Drilling tool holder 1 has a receiving region for a tool with a rinsing channel in a distal projecting region. A cavity is centrally located in a base region of a tool seat of drill tool holder 1, which forms a feed channel 11 for a rinsing medium by an oblique bore outwards.

Drilling tool holder 1 is intermittently and optionally rotationally driven by a transfer part 2 into the extended and the retracted position, based on the work, with respect to a housing 3.

In order to ensure an uninterrupted supply of a rinsing agent to the tool, a feeder 4 has an axially symmetrical radial recess with a length which corresponds at least to a distance between the extended and retracted position of drilling tool holder 1.

Feeder 4 is firmly connected with a holding part 5 to form a component 4, 5, in which there is arranged a rinsing medium inlet 51 in holding part 5 with a connection to the radial recess in feeder 4.

Friction bearings or guide belts 41, 41' directed distally inwards to the axis and seals 42, 42' arranged towards drilling tool holder 1 are arranged on both sides of the radial recess in feeder 4.

A component composed of feeder 4 and holding part 5 bears against the outer surface of drilling tool holder 1 via bearings 41, 41' and seals 42, 42' on the one hand and the other hand is loosely guided by holding part 5 from housing 3 with fixing ring 31.

A loose guidance is carried out such that component 4, 5 is displaceable in the radial direction, but tangentially a flat or the like stop prevents a rotation of the component, so that feeder 4, as it were "floating" on drilling tool holder 1, follows the radial displacement thereof.

According to embodiments, bearing bushing 6 in housing 3 for drilling tool holder 1 can be fixed by axially adjacent spacer element 61 and feeder 4 for a rinsing medium, as illustrated in the FIGURE. After a release of a fixing ring 31 in a simple manner during a repair of the hammer drill and after removal of drilling tool holder 1, feeder 4 and bearing bushing 6 with spacer element 61 can be drawn off and serviced parts can be inserted into housing 3 again.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMERALS

1 Drilling tool holder
11 Supply channel for rinsing medium
2 Transfer part
3 Housing
31 Fixing ring
4 Feed means
41, 41' Friction bearing
42, 42' Seal
5 Holding part
51 Rinsing medium inlet
6 Bearing bushing
61 Spacer element

What is claimed:

1. A device for supplying a rinsing medium to a tool of a hammer drill, comprising:

at least one of a rotatable and axially displaceable drilling tool holder having a tool seat and at least one supply channel for the rinsing medium;

a transfer part coupled to drive the drilling tool holder;

a housing surrounding at least part of the drilling tool holder and part of the transfer part;

a feeder, surrounding the drilling tool holder, that is structured and shaped essentially in an axially symmetrical manner and in fluid communication with the at least one supply channel to supply the rinsing medium to the tool seat through the drilling tool holder;

a holding part, surrounding the feeder, with a rinsing medium inlet;

the feeder and the holding part being arranged as a connected component; and friction bearings being arranged on both axial sides of the feeder and arranged toward the drilling tool holder, wherein the holding part is structured to be radially displaceable within limits via bending with respect to at least one of the housing and a fixing ring connected to the housing, but rotationally fixed.

2. The device according to claim 1, wherein the hammer drill is a taphole power drill.

3. The device according to claim 1, wherein the feeder and the holding part form a permanently connected component.

4. The device according to claim 1, wherein the friction bearings comprise guide belts and seals.

5. The device according to claim 4, wherein at least one belt and at least one seal are located on each side of the feeder.

6. The device according to claim 1, wherein the feeder is structured with an axial extent that corresponds to an axial extent of movement for the drilling tool holder.

7. The device according to claim 6, wherein the drilling tool holder comprises a tool receiving region.

8. The device according to claim 7, wherein a feed channel is arranged to communicate the rinsing fluid from the feeder to the tool receiving region.

9. The device according to claim 1, wherein the feeder is radially displaceable with the holding part.

10. The device according to claim 9, further comprising a bearing bushing axially adjacent the feeder.

11. The device according to claim 10, further comprising a spacer element axially adjacent the bearing bushing.

12. The device according to claim 11, wherein the spacer element is arranged to surround at least a portion of the feeder.

13. The device according to claim 1, wherein the fixing ring is releasable from the housing to facilitate removal of the holding part and the feeder.

14. The device according to claim 13, wherein the friction bearings are removable with the feeder.

15. A hammer drill comprising:

at least one of a rotatable and axially displaceable drilling tool holder having a tool receiving channel;

a transfer part structured and arranged to at least one of rotate and axially displace the drilling tool holder;

a feeder, having a feeder channel, surrounding the drilling tool holder and having an axial extent that corresponds to an axial displacement distance of the drilling tool holder; and a rinsing fluid channel formed in the drilling tool holder to convey rinsing fluid from the feeder to the tool receiving channel.

16. The hammer drill according to claim 15, further comprising friction bearings axially spaced to be arranged on opposite sides of the feeder channel to contact the drilling tool holder.

17. The hammer drill according to claim 15, further comprising a holding part having a rinsing medium inlet, and the holding part being arranged to surround the feeder and being structured to be radially adjustable.

18. A device for supplying a rinsing medium to a tool of a hammer drill, comprising:

at least one of a rotatable and axially displaceable drilling tool holder having a tool seat and at least one supply channel for the rinsing medium;

a transfer part coupled to a distal portion of the drilling tool holder;

a housing surrounding the distal portion of the drilling tool holder;

a feeder, surrounding the drilling tool holder, that is structured and shaped essentially in an axially symmetrical manner and in fluid communication with the at least one supply channel to supply the rinsing medium to the tool seat through the drilling tool holder; and a holding part, surrounding the drilling tool holder, with a rinsing medium inlet;

the feeder and the holding part being arranged as a connected component;

friction bearings being arranged on both axial sides of the feeder and arranged toward the drilling tool holder, wherein the holding part is structured to be radially displaceable with respect to at least one of the housing and a fixing ring connected to the housing, but rotationally fixed.

19. The device according to claim 1, wherein the at least one supply channel obliquely extends from a region of the tool seat to an exterior surface of the drilling tool holder.

20. The device according to claim 18, wherein the at least one supply channel obliquely extends from a region of the tool seat to an exterior surface of the drilling tool holder.

* * * * *